United States Patent [19]

Gomoll et al.

[11] Patent Number: 4,773,777

[45] Date of Patent: Sep. 27, 1988

[54] MULTICOLOR RIBBON SHIFTER WITH SEPARATE CAMS FOR THE CASSETTE AND GUIDE

[75] Inventors: Guenter Gomoll, Nersingen/Leibi; Wolfgang Hauslaib, Langenau, both of Fed. Rep. of Germany

[73] Assignee: Mannesmann AG, Duesseldorf, Fed. Rep. of Germany

[21] Appl. No.: 926,020

[22] Filed: Oct. 31, 1986

[30] Foreign Application Priority Data

Oct. 31, 1985 [DE] Fed. Rep. of Germany ..... 3538761

[51] Int. Cl.[4] ..... B41J 35/14

[52] U.S. Cl. ..... 400/212; 400/216.1; 400/248

[58] Field of Search ..... 400/211, 212, 216, 216.1, 400/216.2, 216.5, 215, 217, 697, 208, 196.1, 248

[56] References Cited

U.S. PATENT DOCUMENTS 3,595,362 7/1971 Wolowitz ..... 400/216.2
4,568,209 2/1986 Zerillo ..... 400/216.1

FOREIGN PATENT DOCUMENTS 0059923 9/1982 European Pat. Off. ..... 400/214
0158963 10/1985 European Pat. Off. ..... 400/216.1
0193684 10/1985 Japan ..... 400/216.1

*Primary Examiner*—David A. Wiecking
*Attorney, Agent, or Firm*—Ralf H. Siegemund

[57] ABSTRACT

In a printer having a platen, a printhead carriage moving along the platen, the mounting of a multicolor band ribbon with ribbon case and of a ribbon guide is improved by pivoting one end of the ribbon casing to the frame, and one end of the guide to the carriage; two cams are mounted axially immobile on a shaft and against the ribbon case such that different portions of these cams depending upon the rotational position of the shaft determines the pivot position of the case to thereby place different color bands in between said print heads and said platen; the frame for the ribbon guide is held by another cam mounted for axial movement with said carriage but rotating with the shaft so that all cams rotate in synchronism.

4 Claims, 3 Drawing Sheets

MULTICOLOR RIBBON SHIFTER WITH SEPARATE CAMS FOR THE CASSETTE AND GUIDE

BACKGROUND OF THE INVENTION

The present invention relates to a printer particularly a matrix printer with switch-over structure as far as color printing is concerned under utilization of a multi-band multicolor ink ribbon. Printers of the type to which the invention pertains use a common ink ribbon having several parallel oriented dye zones or bands of different color and being mounted in stationary ribbon casing from which the ribbon emerges on one end, passes a platen in longitudinal direction along which the print head runs, there being suitable cooperation between the print location defined by the position of the matrix head and the ribbon. The ribbon reenters the ribbon casing at another suitable location such as another casing and establishes in some fashion, possibly including the inside of the casing, a closed loop kind of ribbon path configuration.

The switch over structure for a change in the effective color band of a multicolor band ribbon permits sequential printing in blue, black, green, red and yellow except that cyan is often used in lieu of straight forward blue, and magenta in lieu of regular red. These primary colors can then be used in such a printer for obtaining a multicolor printout by composing images of any kind from at least optically-visually overlapping or merging different color dots.

Basically one distinguishes between two kinds of ribbon cases for cooperation with a matrix type printhead or the like. Smaller ribbon cases or cassettes are mounted onto the particular carriage for the printhead being a type wheel or a multistylus matrix print head. This type of construction limits of course the amount of ribbon that can be made available in a such a cassette so that the available dye and ink supply in a simple cassette is quite limited. Also, there is inherently a fairly small pivot radius as far as changing the orientation of the cassette vis-a-vis the respective print element is concerned. This is added disadvantage because the oppositely oriented curvature of the print platen adds to the limitation of available print area. Larger ink ribbon cassettes may be mounted directly in the printer casing or frame and they transport the ribbon in loop from an exit of this ribbon casing or cassette and back into it as was mentioned above. The invention pertains to this latter kind of multicolor printing and cassette assembly. It should be noted that these larger ribbon casings are able to contain more than 10 even up to 20-fold the amount of ribbon material that can be accommodated in the earlier mentioned small ribbon cassettes which are mounted on the print casing and carriage itself. An example of a small kind of ribbon cassettes with associated switch over structure for multizone or band ribbons are shown in German printed Patent No. 30 14 820.

DESCRIPTION OF THE INVENTION

It is an object of the present invention to provide a new and improved adjustment for the position of a multicolor-band-ink ribbon in printers particularly for rather wide printers, to be right in front of the print platen under utilization of comparable flat or planar movements of the ribbon vis-a-vis the platen for purposes of color band adjustment.

In accordance with the preferred embodiment of the present invention it is suggested to provide a pivot support for the ribbon case, permitting pivoting thereof on an axis parallel to the direction of movement of the print element carrier but remote from the platen; at least one rotatable but axial unshiftable or undisplaceable cam to obtain the pivoting; at least one second cam being mounted on and moving with the print element carrier, the second cam is likewise rotatably mounted and a frame is provided bearing against this second cam and holding the ink ribbon guide; all of these cams are adjusted and turned in steps and in synchronism with each other.

It was found that this arrangement establishes a rather flat almost planar or straight movement of the ribbon in front of the platen and permits a very accurate positioning of the individual color bands of the ribbon vis-a-vis the print elements. Moreover, the ribbon is guided and adjusted into the respective positions quite accurately, from one end of the ribbon to the other to the extent the ribbon is available for printing. The reciprocating movement of the print element carrier is not followed by the ribbon casing and its mount but the second cam adjusting the ribbon guide does. The aforementioned rather flat trajectory of movement of the ribbon can be improved further if the ribbon guide frame is pivotably mounted above a horizontal axis that is also arranged to the side of the print element carrier which faces away from the print platen.

It is further suggested to provide the two cams or sets of cams mentioned above, on a common, driven follower shaft; the first cam or cams are mounted on that shaft in a manner that does not permit any relative movement in relation to the shaft so that these cams follow any rotation of the shaft. The second cam or cams in the above rotation do undergo axial movement on that shaft on account of the print element carrier of the follower shaft. This ensures uniform (synchronous) and accurate operation of the various cams.

Still in furtherance of the invention it is suggested to rotate the follower shaft as it is mentioned in the preceding paragraph by means of a stepwise operated electromotor having interposed between its output shaft and the follower shaft a speed reducing transmission or gear. As this motor is turned on, the cams should "home" into a particular zero or null or starting position which causes the ribbon casing and the ribbon guide to assume a particular position. Accordingly, a structure is provided to insure the return of the parts into this null position wherein only one particular ribbon band is placed into a printing position. This approach ensures that start up from a zero position to any other ribbon band can be carried out with the same degree of accuracy in each instance of adjustment so that thereafter the formation of multicolored images is ensured. This zero position can be obtained accurately, and in a rather economic fashion, in that the follower shaft carries a gear being secured thereto and pertaining to the speed reduction gear but having a particular gear with cam which on return of the motor can bear against a stop of the printer frame.

Figure 1:
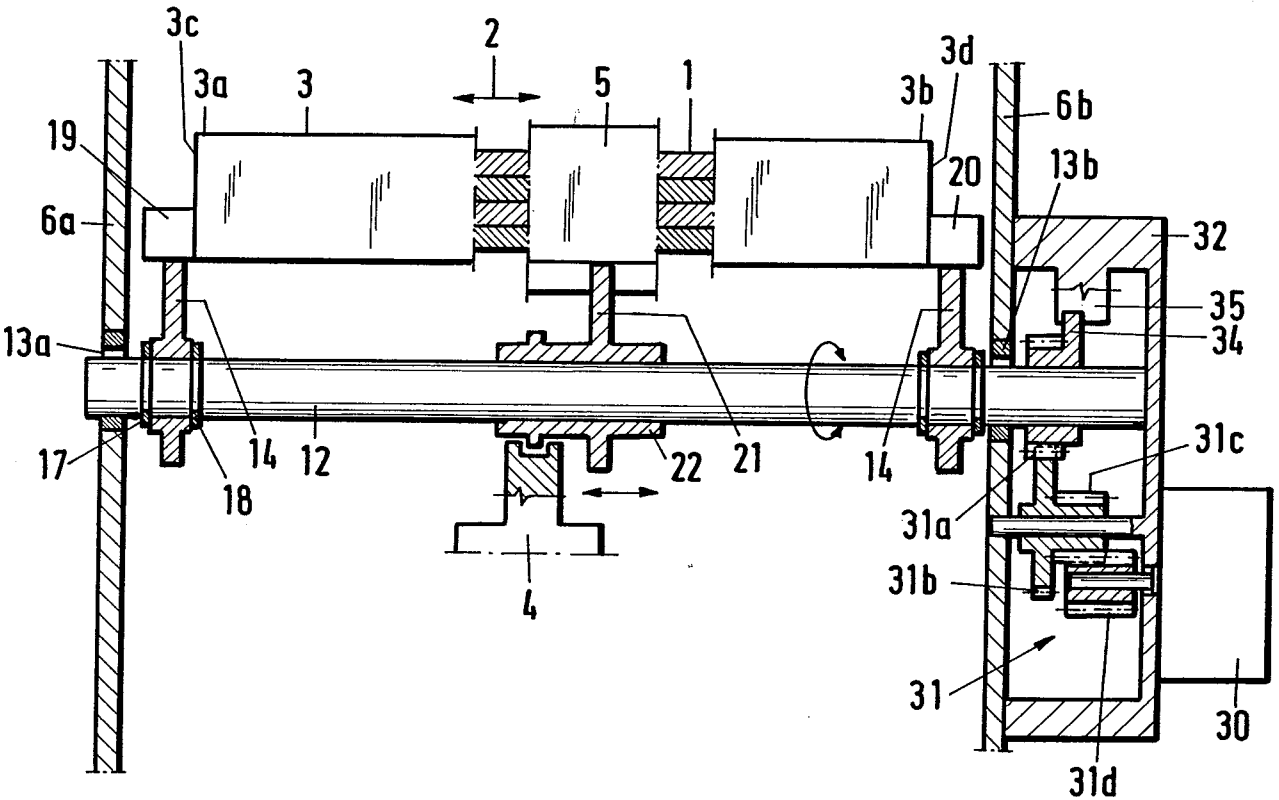
FIG. 1 is a front view of a matrix printer improved in accordance with the preferred embodiment of the present invention, the view is into the printer from the side of normal operator access.

Proceeding now to the detailed description of the drawing the figures show a matrix printer which includes a print element carrier 4 and a printing platen 4*a*. The print elements, themselves, are not shown but they face the platen 4*a* across a gap 15. The carriage 4 is driven along the platen and here one usually provides a kind of rope and pulling arrangement such that the carriage 4 can reciprocate parallel to and along the platen 4*a*. The carriage or carrier 4 rides on two shafts 10 and 11. The entire arrangement of the printer including the portions to be described below are mounted and held in a frame 6 that includes sides or side walls 6*a* and 6*b*. The shafts 10 and 11 are connected to and mounted between side walls 6*a* and 6*b* and can be deemed part of the printer frame structure.

Reference numeral 1 denotes a multi-color-band ink ribbon, in this case a four color ink ribbon, wherein the color zones or bands run parallel to each other and are juxtaposed on that ribbon. Reference numeral 2 refers to the longitudinal direction (bi-dimensional) generally as far as ink movement in the print position is concerned. The number of color bands and the type of colors used is insignificant for the invention.

The ribbon is normally contained in a ribbon case 3 which in this case is not mounted to the print element carrier or carriage 4 and, therefore, does not follow the longitudinal motion of the carrier or carriage 4. Rather and with reference to the carriage movement the ribbon case remains stationary and has invariant position in relation to the platen 4*a* as far as the longitudinal direction of extension of the platen 4*a* is concerned. This does not mean that the case 3 is stationary in an absolute sense. Rather it can be pivoted by means of the mechanism that will be described next and which constitutes a basic combinatory feature of the present invention.

As a preliminary it should be mentioned that during normal operation the multicolor band ribbon 1 is continuously moved from the case 3 and here from one end thereof whereupon the ribbon is moved past the platen 4*a* and picked up at another end; specifically the ribbon case is generally of U-shaped configuration wherein the bottom part of the U extends substantially over the length of the platen. The legs 3*a* and 3*b* extend towards the platen. The ribbon 1 emerges from one leg (e.g. 3*a*) and is fed back into the casing 3 through the other leg (e.g. 3*b*). The print head basically moves in between the legs i.e. in the space defined by the legs 3*a* and 3*b* and by the surface 3*e* of the casing that faces the platen. Temporarily the ribbon is held by means of the guide 5 in printing position which is part of and mounted to the print member carriage or carrier 4. The print head itself can be a matrix print head, a type wheel or the like. The print process proper is not immediately material for the invention. Following passage through the print position at guide 5 the ribbon is moved back to the casing and 3*b* as stated. Hence the ribbon 1 performs a kind of a loop in order to insure uniform wear.

The color band switch over structure is constructed in accordance with the principle of a complete structural separation of the ribbon case 3 from the ribbon guide 5. Pivot mounts or journal mounts 7 on the side walls 6*a* and 6*b* of frame 6 establish an axis 8 which runs through the printer as a hypothetical axis. Pins 9 are provided on the side faces 3*c* and 3*d* of the ribbon case 3 such that the case 3 can pivot about the axis 8. Specifically, that end of case 3 is pivotally mounted in this manner which faces away from the platen 4*a*. Thus the axis 8 moreover is disposed in an area or region of the case which is away from the platen 4*a*. One can also say that the axis 8 extends through a part of the printer which is on the other side of the head carriage 4 as compared with the location of the platen 4*a* with respect to that head carriage 4.

A follower shaft 12 is provided and likewise rotatably mounted in the side walls 6*a* and 6*b*. The shaft 12 extends above the carriage 4. The follower shaft 12 has a cross section resembling a D thus providing a keying function by means of which certain components seated on the shaft 12 can, on one hand, slide axially on the shaft 12 while following the rotation of the shaft 12. As shown in FIG. 1 the D-shape permits and establishes a small arcuate gap in the bearing 13*a* and 13*b* which however is not important for the function.

Figure 2:
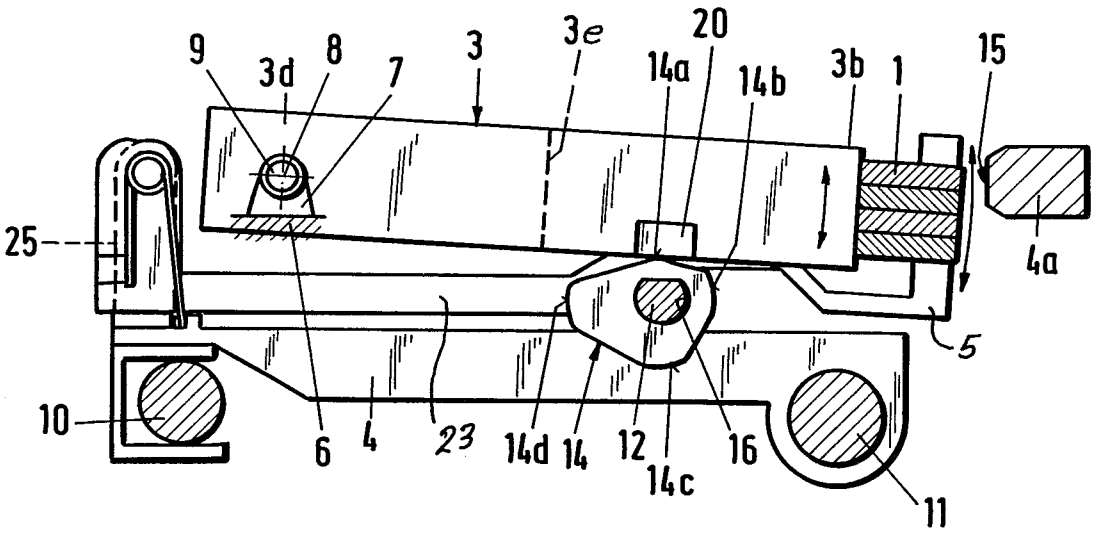
FIG. 2 is a section view of this printer shown in FIG. 1 showing the print element carrier as well as the ink ribbon casing and parts of the ribbon guide in such view.

The ribbon casing 3 bears against two curved cams 14 on the side facing the platen 4*a*. This is particularly shown in FIG. 2. The cams 14 constitute a first set of cams. They are mounted near opposite ends of shaft 12 but inside the frame space as defined by walls 6*a* and 6*b*. The curved cams 4 each are provided with four sections 14*a* and *b* and *c* and *d* corresponding to the four color bands of the ribbon 1. Each of these sections 14*a*–14*d* has a different diameter in terms of radial distance from the cam and shaft (12) center. Each of these curved sections 14*a*–14*d* are separated from the respective next ones by straight part transitions. FIG. 2 illustrates the normal or null position established by the lowest cam section 14*a* as far as positioning ribbon casing 3 is concerned such that the casing 3 and the ribbon 1 assumes in its free end the lowest pivot position vis-a-vis the platen 4*a* corresponding to a disposition of the top color band adjacent to platen 14*a*. The cam sections 14*b,c,d* are characterized by progressively larger diameter, corresponding to larger and larger pivot angles of case 3 in counterclockwise direction of FIGS. 2 and 3. The ribbon casing 3 bears against the two cams 14 whereby particularly lugs 19 and 20 are provided respectively extending from the guide faces 3*c* and 3*d* of the casing 3 by means of which the first positions of the cams 14 is established. One can also readily see that the rather large pivot radius with a center on axis 8 and measured from that axis to the print position 15 on the band 1, is so large that in the area of printing 15 the movement of the ribbon is readily approximated and with comparatively small error only to be a near planar movement in the area of printing. This is of course true for all four bands of the ribbon.

As shown in FIG. 1 the two cams 14 are duplicates of each other and each fulfills the same function just at a different location within the printer. Each of these cams 14 has a central opening corresponding to the D of the shaft 12; the opening being denoted by reference numeral 16. The cams 14 are fastened to shaft 12 by means of axially effective securing and locking disk 17 and 18. These cams 14 are not only compelled to follow the rotation of the shaft 12 but they are immobilized axially on that shaft.

As far as follower shaft 12 with D cross section is concerned it carries an additional cam 21 and again there could be more than one cam. The cam 21 has a hub 22 by means of which the cam is forced to follow any rotation. The hub 22 moreover is constructed such that the cam 21 can axially slide on the shaft 12. Cam 21 is connected to the carriage 4 in a positive manner, at least sufficient to follow motion of the carriage 4 in either direction while rotation of the shaft 12 is radially transmitted upon the cam 21 which will follow positively the rotation thereof.

The cam 21 is likewise divided into curved sections 21*a,b,c,d.* These sections are configured analogously to the curved sections 14*a*–14*d.* Also just as in case of cam 14 the various sections 21*a*–21*d* of the cam 21 are separated by straight transition portions. A frame 23 is provided on the carriage 4 for the support of the ribbon guide 5 at the front end 5*a* of frame 23. The rear end 5*b* of frame 23 is provided as a pivot mount 24 which in turn is also arranged on the carriage 4 so that the frame 23 will follow the motion of the carriage 4 but being capable of pivoting in relation thereto.

The bearing and pivot means 24 on carriage 4 is comprised of one or two bearing mounts 25 being directly mounted to the carriage 4 and being secured thereto. Posts 26 in the rear end 5*b* of the frame 23 and these posts carry bearing pins 27. The pins 27 in turn are received by the bearings 25 on carriage 4. Springs 28 are seated on the pins 27. One leg 26*a* of each spring 28 bears against a stop 28*a* being mounted to the respective element 26. The other leg, 28*b,* bears against a stop 4*b* being part of and mounted to the carriage 4.

Figure 3:
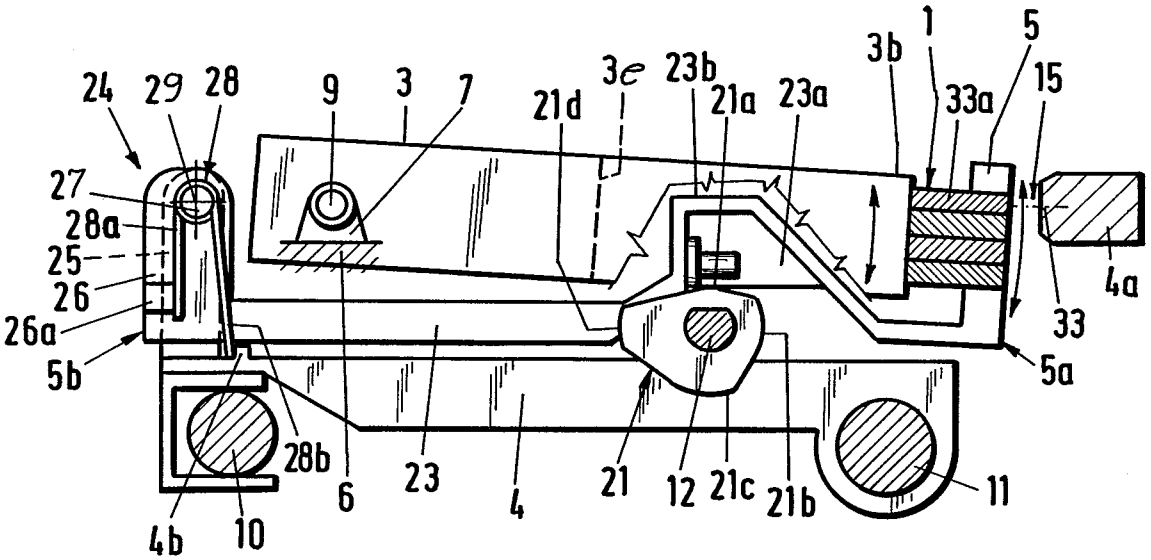
FIG. 3 is also a section view such as FIG. 2 but with a view towards a detailing illustration of the ink ribbon adjustment structure.

The springs 28 are biased and cause the frame 23 to pivot about the horizontal axis 29 of the pins 27 such that the frame 23 is forced clockwise as far as FIGS. 2 and 3 are concerned so that a rib 23*a* of frame 23 bears against a cam 21 and here the particular upward printing portion or section thereof. FIG. 3 particularly shows the shortest radius cam section, 21*a* to place frame 23 into the lowest possible pivot position. The rib 23*a* is mounted in and extends from an indent 23*b* of the frame 23. This indent 23*b* takes advantage here of the interior space of the casing 3 being established and provided between the two ends 3*a* and 3*b* and within which the print organ such as a matrix print head or type wheel will appear in the carriage 4. As stated, the print element is moved back and forth along the platen 4*a* between the legs 3*a,b* of the ribbon casing 3.

Shaft 12 is stepwise driven by a motor 30 there being a reducing gear 31 interposed. The reducing gear 31 is encased by a bearing housing 32 and secured to the frame 6 of the printer. The gear 31 includes meshing gears 31*a,b,c,d* and a reduced speed is thus imparted upon shaft 12. Upon turning on the motor 30 a null position 33 obtains automatically according to which a particular color band such as 33*a* is made to coincide with a center of the platen as it faces the print elements. This is the illustrated position (FIGS. 2,3) of the printer. This zero position obtains through gear 31 which sits on shaft 12 and is provided with a protrusion 34 which bears against a stop 35 of the frame 6 of the printer. This then defines the null position of shaft 12 and, therefore, of all the cams thereon and further adjustments proceeds out of that position. The pairs or groups of curved sections such as 14*a*/21*a;* 14*b*/21*b;* 14*c*/21*c* and 14*d*/21*d* cause the pivot operation of ribbon adjustment. During printing multicolor band 1 is moved continuously in direction 2 in a loop path in order to obtain uniform wear.

The invention is not limited to the embodiments described above but all changes and modifications thereof not constituting departure from the spirit and scope of the invention are intended to be included.

We claim:

1. In a printer which comprises a platen, a printhead carriage moving along the platen, the platen being mounted to a frame of the printer, there being a multicolor band ribbon with ribbon case in the printer the improvement of positioning and mounting said ribbon case in said printer frame in particular spatial relation to said platen such that progressively the one or the other of the several color bands of the ribbon can be positioned in between the print head and the platen, comprising:

means for mounting one end of the ribbon case to said printer frame such that the resulting pivot axis extends parallel to the direction of print carriage movement as well as a direction of extension of the platen but at a location facing away from the platen, the print head being disposed in between accordingly, the print head moving axially parallel to the platen and relative to the ribbon case during pivoting;

at least one first rotatable but axially immobile cam for bearing against said ribbon case such that different portions of the first cam, depending upon different and angular dispositions of the first cam, determine the pivot position of the case as pivotally mounted to thereby place different color bands in between said print head and said platen;

a guide frame pivotally mounted to said carriage and axially moving therewith;

a ribbon guide for holding the ribbon in front of said printhead and being mounted to said guide frame; and at least one second cam mounted for axial movement with said carriage and being rotatably connected to said at least one first cam for synchronous rotation therewith, said second cam bearing against said ribbon guide for obtaining different positions of said ribbon guide in synchronism with pivot positions for the ribbon case as established by said first cam or cams.

2. The improvement as in claim 1 wherein said guide frame is likewise pivotally mounted on a side on the carriage facing away from the platen.

3. The improvement as in claim 1 and including a follower shaft; said first and second cams being keyed to said follower shaft for common rotation depending upon rotation and turning of said follower shaft, said first cam or cams being additionally mounted to said follower shaft to prevent axial movement of the first cam or cams, said second cam being permitted to axially move on said follower shaft but following any rotation thereof.

4. The improvement as in claim 3 including a step motor and a reduction gear coupling the step motor to said follower shaft, and means for causing said follower shaft to assume a particular null position upon turn-on of the motor.

* * * * *